US009420929B2

(12) United States Patent
Hensel et al.

(10) Patent No.: US 9,420,929 B2
(45) Date of Patent: Aug. 23, 2016

(54) VACUUM APPLIANCE

(71) Applicant: Alfred Kärcher GmbH & Co. KG, Winnenden (DE)

(72) Inventors: Maic Hensel, Backnang (DE); Steffen Layer, Stuttgart (DE)

(73) Assignee: Alfred Kärcher GmbH & Co. KG, Winnenden (DE)

( * ) Notice: Subject to any disclaimer, the term of this patent is extended or adjusted under 35 U.S.C. 154(b) by 513 days.

(21) Appl. No.: 13/887,769

(22) Filed: May 6, 2013

(65) Prior Publication Data

US 2013/0239360 A1 Sep. 19, 2013

Related U.S. Application Data

(63) Continuation of application No. PCT/EP2011/068776, filed on Oct. 26, 2011.

(30) Foreign Application Priority Data

Nov. 8, 2010 (DE) ..... 10 2010 043 577

(51) Int. Cl.

| | |
|---|---|
| ***A47L 5/00*** | (2006.01) |
| ***A47L 9/28*** | (2006.01) |
| ***A47L 9/20*** | (2006.01) |
| ***A47L 5/36*** | (2006.01) |
| ***A47L 9/10*** | (2006.01) |

(52) U.S. Cl.

CPC ..... *A47L 9/2884* (2013.01); *A47L 5/365* (2013.01); *A47L 9/10* (2013.01); *A47L 9/20* (2013.01)

(58) Field of Classification Search

CPC ..... A47L 9/2884; A47L 9/10; A47L 9/20

See application file for complete search history.

(56) References Cited

U.S. PATENT DOCUMENTS

| | | | | |
|---|---|---|---|---|
| 5,704,956 | A * | 1/1998 | Loveless | A47L 9/20 15/352 |
| 7,120,965 | B2 * | 10/2006 | Hisano | A47L 9/2884 15/413 |
| 7,472,456 | B2 * | 1/2009 | Moore | A47L 5/365 15/323 |
| 8,590,103 | B2 * | 11/2013 | Wolfe, Jr. | A47L 5/24 15/412 |
| 8,601,640 | B2 * | 12/2013 | Bertram | A47L 9/00 15/327.2 |

(Continued)

FOREIGN PATENT DOCUMENTS

| | | | | |
|---|---|---|---|---|
| DE | 4421458 | A1 * | 12/1995 | A47L 9/00 |
| DE | 20 2005 014 736 | | 3/2006 | |

(Continued)

*Primary Examiner* — Bryan R Muller

(74) *Attorney, Agent, or Firm* — Womble Carlyle Sandridge & Rice LLP

(57) ABSTRACT

A vacuum appliance is provided including a dirt collection container for sucked-in vacuumed material, a suction unit for subjecting the dirt collection container to the action of negative pressure via a suction chamber, at least one filter element between the dirt collection container and the suction chamber in the flow direction of the air sucked in by the suction unit, at least one rechargeable battery for providing electrical energy for the suction unit, and at least one battery receptacle for holding the battery on the vacuum appliance. The vacuum appliance includes a filter cover transferrable from a closed position in which the filter element is covered, to a removal position in which the filter element is removable from and insertable into the vacuum appliance on the clean space side, and vice versa, and which filter cover includes the battery receptacle for the battery.

27 Claims, 6 Drawing Sheets

(56) References Cited

U.S. PATENT DOCUMENTS

Figure 1:
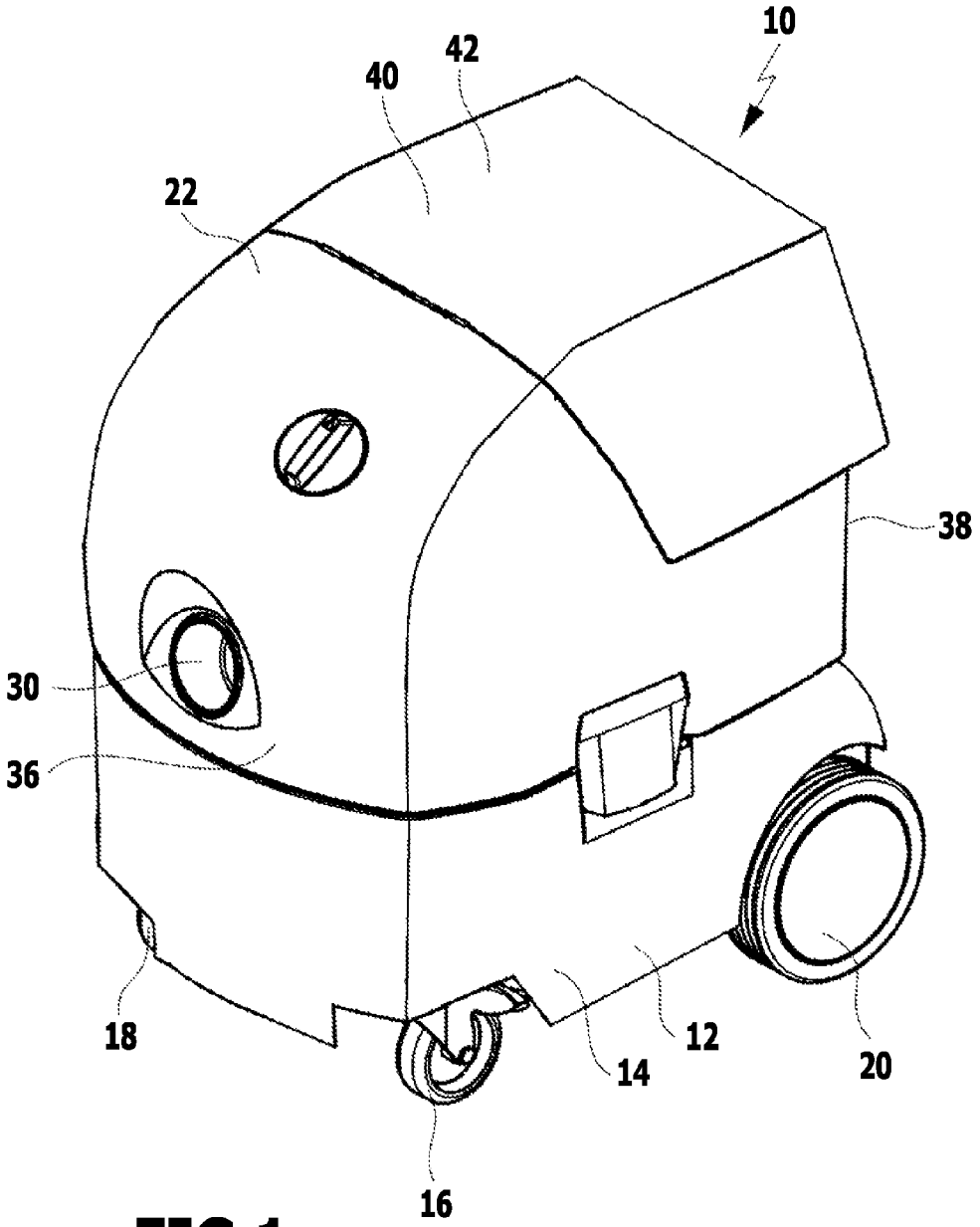

| | | | |
|---|---|---|---|
| 2008/0062618 | A1 | 3/2008 | Frank et al. |
| 2010/0275395 | A1 | 11/2010 | Poch et al. |

FOREIGN PATENT DOCUMENTS

| | | | | |
|---|---|---|---|---|
| DE | 10 2005 007 923 | | 8/2006 | |
| DE | 10 2005 007 925 | | 8/2006 | |
| EP | 2 002 773 | | 12/2008 | |
| JP | H07-327870 | | 12/1995 | |
| JP | 2001 321298 | | 11/2001 | |
| JP | 2003-038403 | | 2/2003 | |
| JP | 3785568 | B2 * | 6/2006 | ..... A47L 9/00 |
| WO | WO 2006/084561 | | 8/2006 | |
| WO | WO 2008/070962 | | 6/2008 | |

* cited by examiner

VACUUM APPLIANCE

CROSS-REFERENCE TO RELATED APPLICATIONS

This application is a continuation of international application number PCT/EP2011/068776, filed on Oct. 26, 2011, and claims the benefit of German application number 10 2010 043 577.5, filed Nov. 8, 2010, the entire specification of both being incorporated herein by reference.

FIELD OF THE INVENTION

The present invention relates to a vacuum appliance comprising a dirt collection container for sucked-in vacuumed material, a suction unit for subjecting the dirt collection container to the action of negative pressure via a suction chamber, at least one filter element situated between the dirt collection container and the suction chamber in the flow direction of the air which is sucked in by the suction unit, at least one rechargeable battery for providing electrical energy for the suction unit, and at least one battery receptacle for holding the at least one battery on the vacuum appliance.

An object underlying the present invention is to provide a vacuum appliance which is operable in a more user-friendly manner.

SUMMARY OF THE INVENTION

In an aspect of the invention, a vacuum appliance comprises a dirt collection container for sucked-in vacuumed material, a suction unit for subjecting the dirt collection container to the action of negative pressure via a suction chamber, at least one filter element situated between the dirt collection container and the suction chamber in the flow direction of the air which is sucked in by the suction unit, at least one rechargeable battery for providing electrical energy for the suction unit, and at least one battery receptacle for holding the at least one battery on the vacuum appliance. The vacuum appliance includes a filter cover which is transferrable from a closed position in which the at least one filter element is covered, into a removal position in which the at least one filter element is removable from and insertable into the vacuum appliance on the clean space side, and vice versa, and which filter cover comprises the at least one battery receptacle for the at least one battery.

BRIEF DESCRIPTION OF THE DRAWING FIGURES

Figure 2:
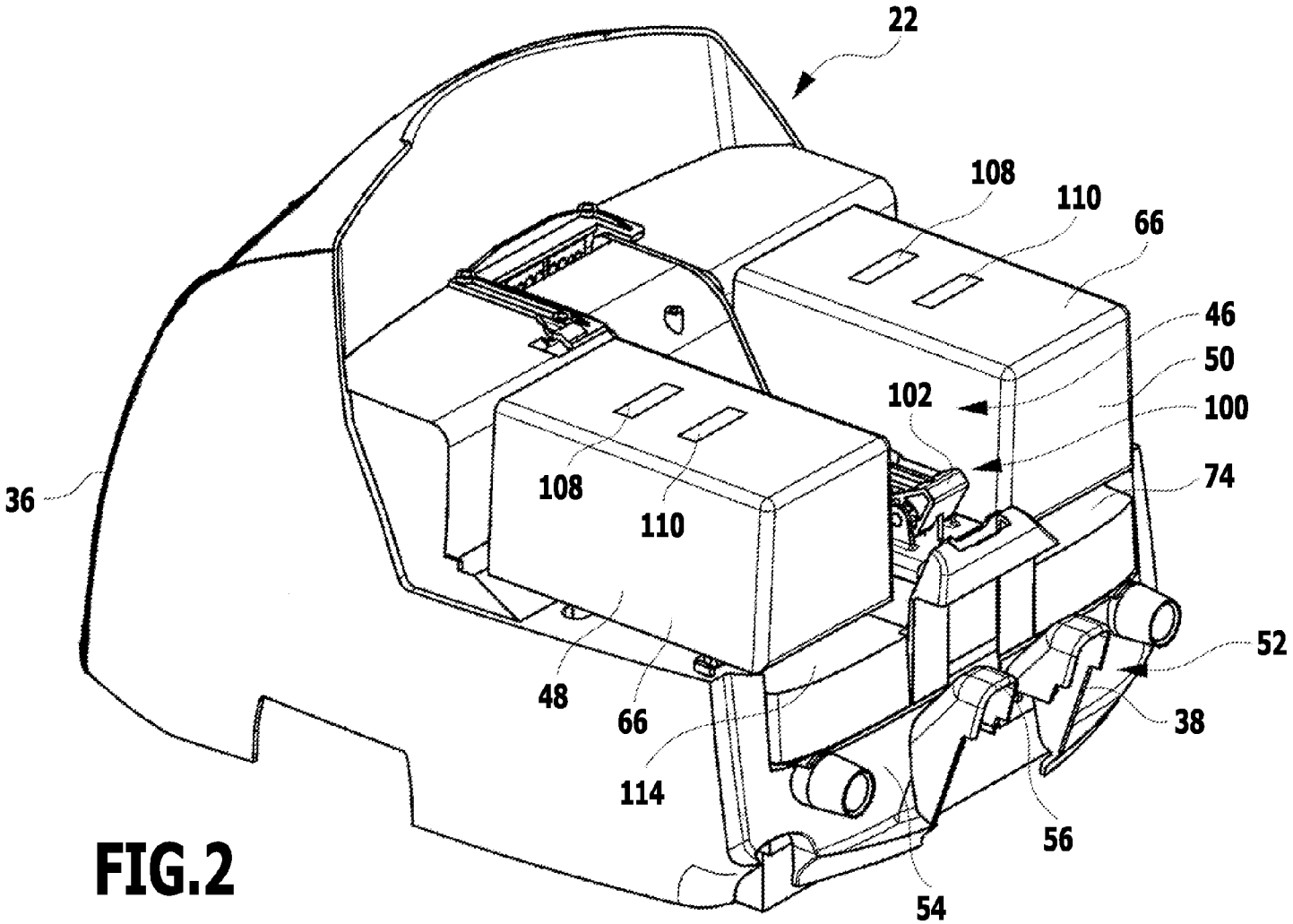
Figure 3:
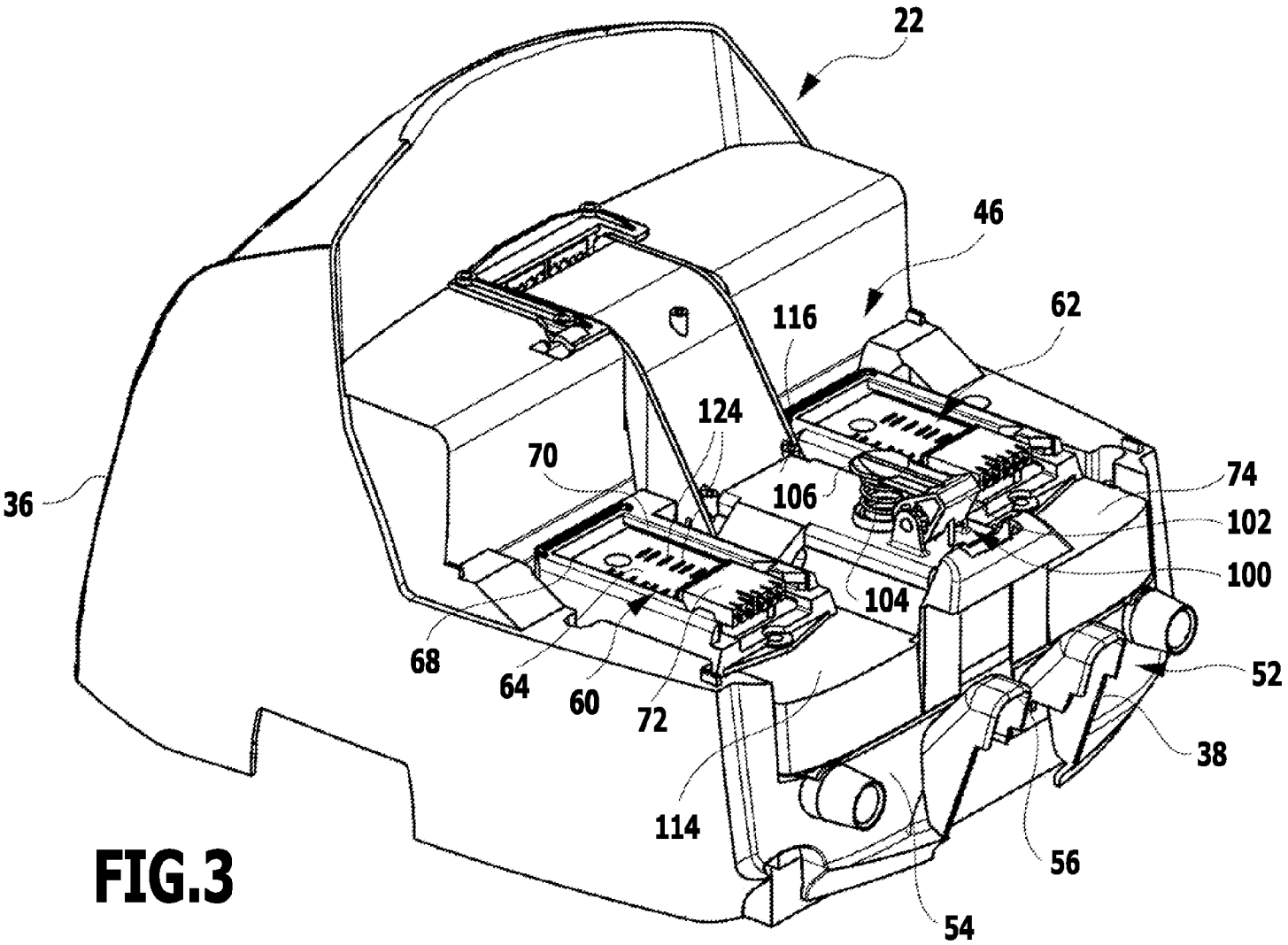
Figure 4:
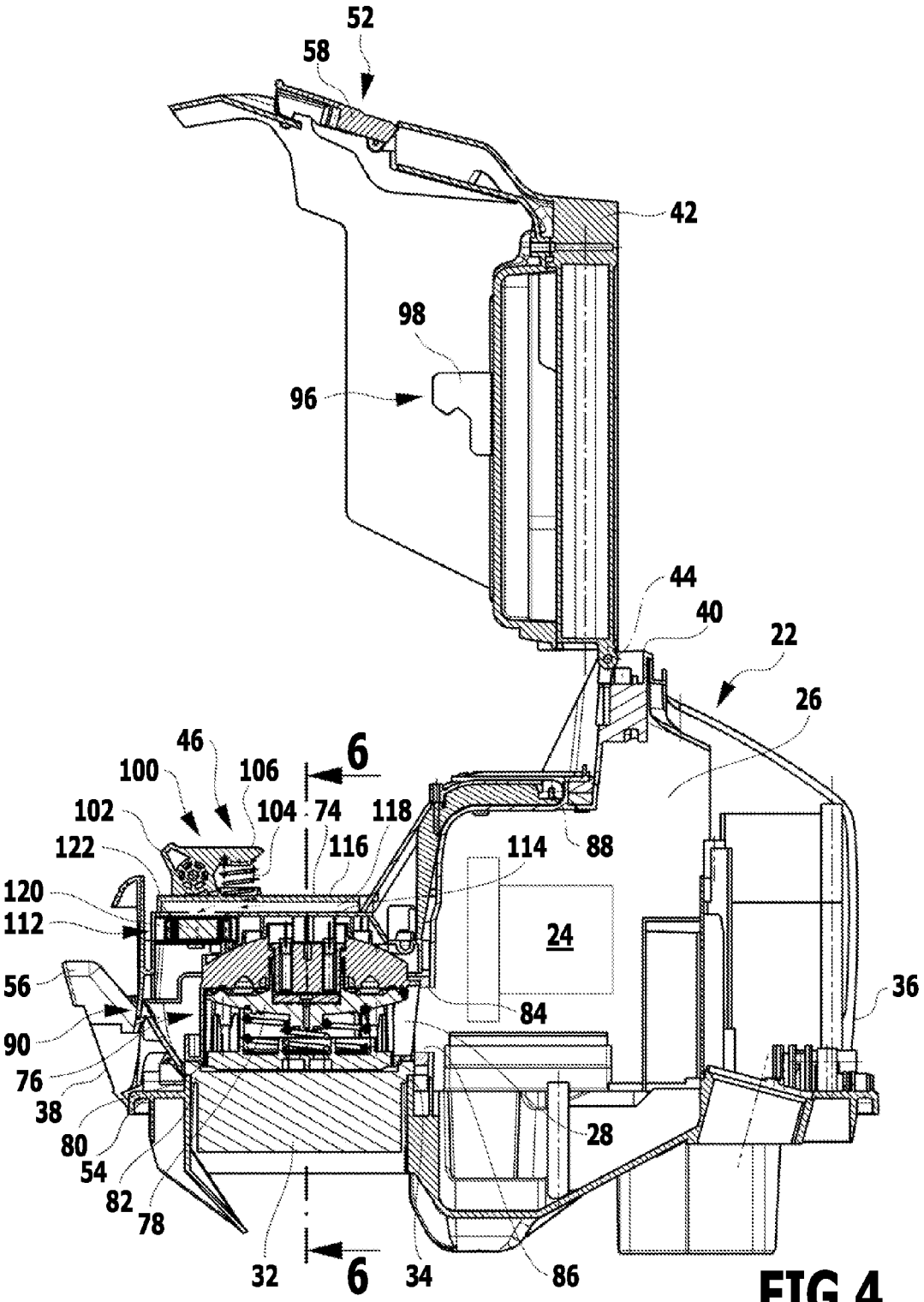
Figure 5:
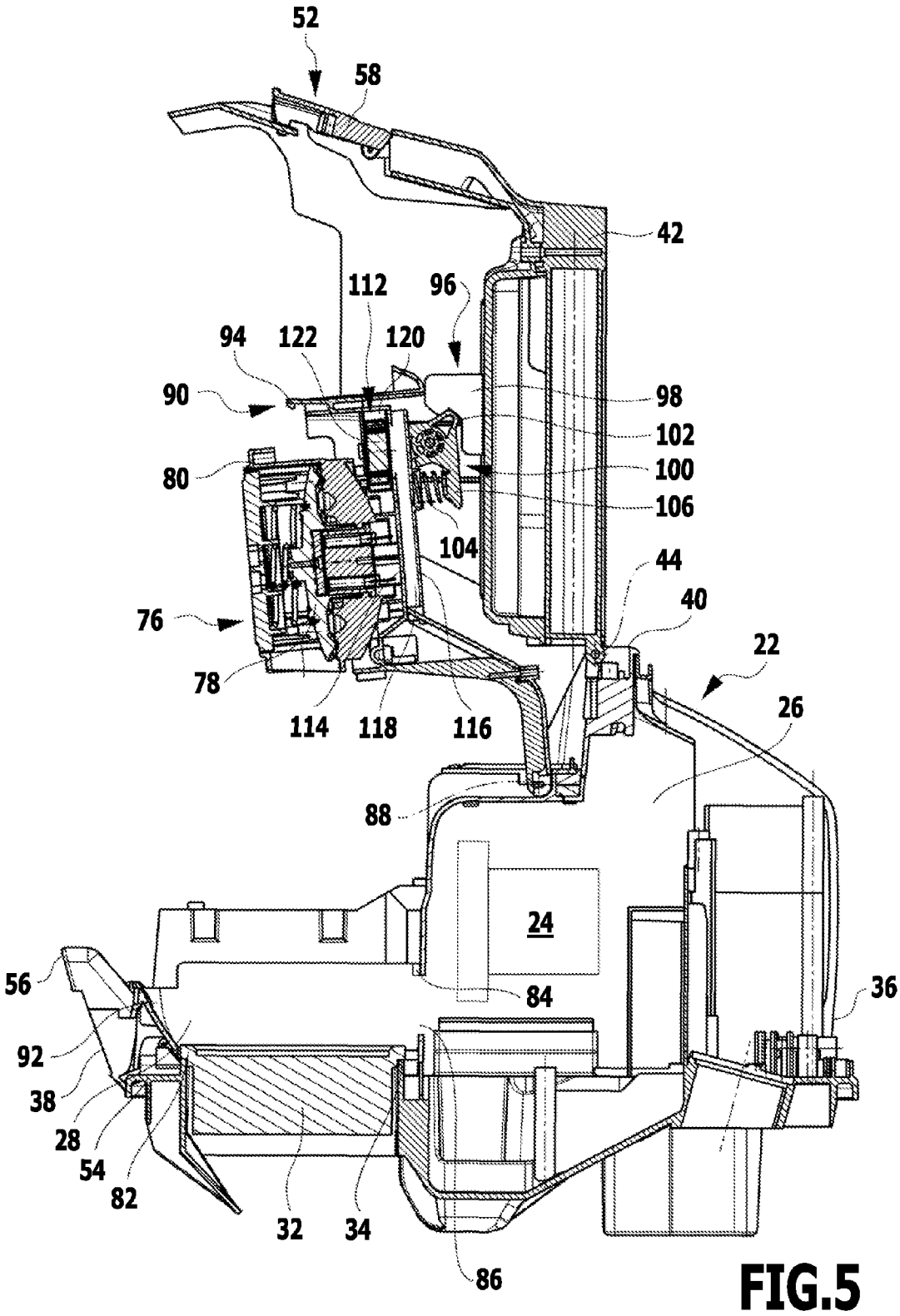
Figure 6:
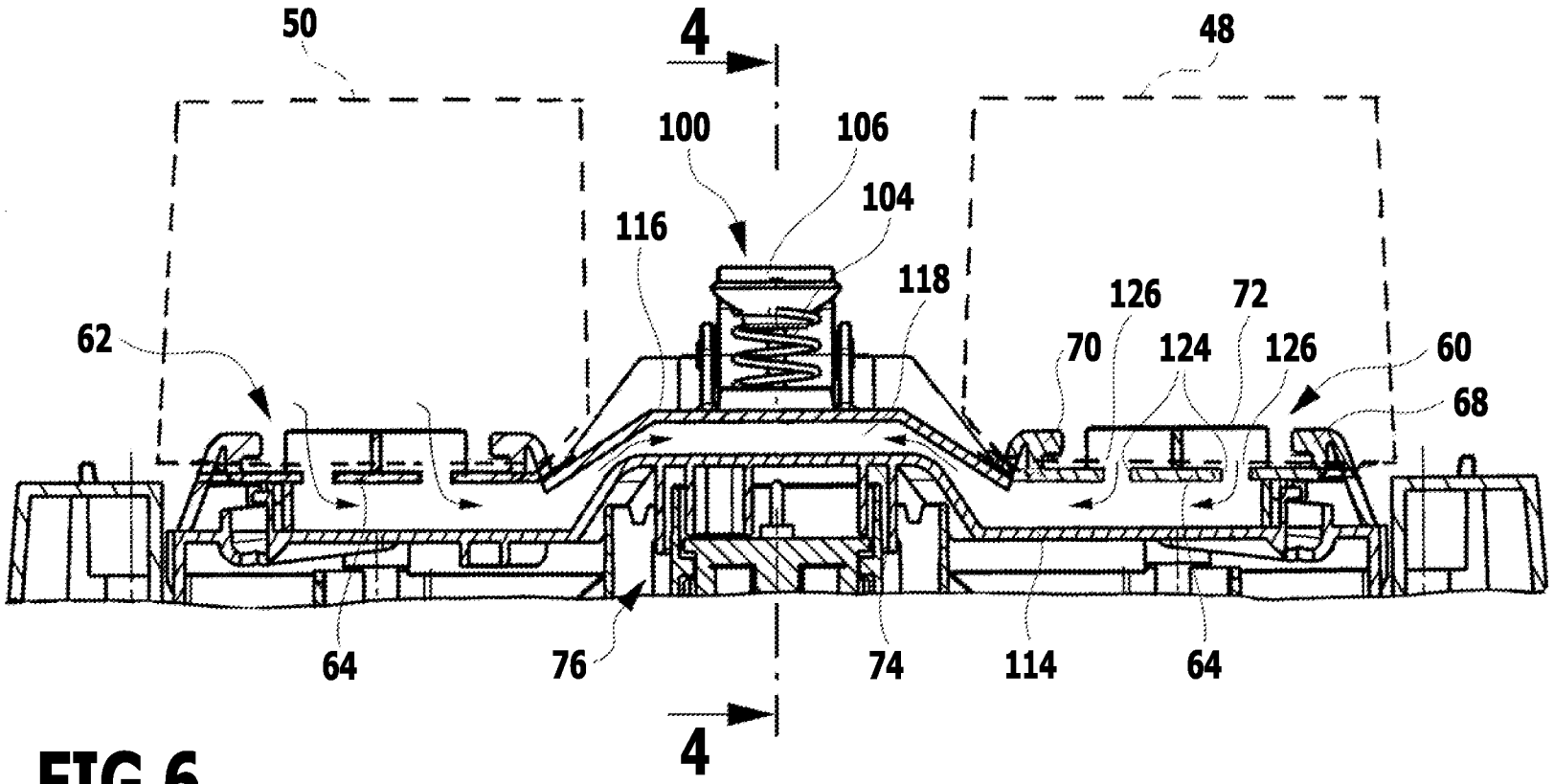

The foregoing summary and the following description may be better understood in conjunction with the drawing figures, of which:

FIG. 1: shows a perspective illustration of a preferred embodiment of a vacuum appliance according to an aspect of the invention;

FIG. 2: shows a perspective illustration of a appliance top part of the vacuum appliance from FIG. 1 with a battery compartment cover omitted, thus affording a view of two rechargeable batteries of the vacuum appliance;

FIG. 3: shows the appliance top part from FIG. 2 after removal of the two batteries of the vacuum appliance from the appliance top part;

FIG. 4: shows a longitudinal sectional view of the appliance top part, with a battery compartment cover of the vacuum appliance in an open position and a filter cover of the vacuum appliance in a closed position (corresponding to a sectional view along the line 4-4 in FIG. 6);

FIG. 5: shows the appliance top part from FIG. 4, with the filter cover in a removal position and the filter cover and the battery compartment cover arrested against one another; and FIG. 6: shows a (partial) sectional view along the line 6-6 in FIG. 4.

DETAILED DESCRIPTION OF PREFERRED EMBODIMENTS OF THE INVENTION

Although the invention is illustrated and described herein with reference to specific embodiments, the invention is not intended to be limited to the details shown. Rather, various modifications may be made in the details within the scope and range of equivalents of the claims and without departing from the invention.

The present invention relates to a vacuum appliance comprising a dirt collection container for sucked-in vacuumed material, a suction unit for subjecting the dirt collection container to the action of negative pressure via a suction chamber, at least one filter element situated between the dirt collection container and the suction chamber in the flow direction of the air which is sucked in by the suction unit, at least one rechargeable battery for providing electrical energy for the suction unit, and at least one battery receptacle for holding the at least one battery on the vacuum appliance. The vacuum appliance includes a filter cover which is transferrable from a closed position in which the at least one filter element is covered, into a removal position in which the at least one filter element is removable from and insertable into the vacuum appliance on the clean space side, and vice versa, and which filter cover comprises the at least one battery receptacle for the at least one battery.

In the vacuum appliance according to an aspect of the invention, the user may transfer the filter cover from a closed position in which it covers the at least one filter element and closes off the suction chamber, into a removal position. In the removal position of the filter cover, the at least one filter element may be removed from the vacuum appliance on the clean space side in a user-friendly manner. The user is thus relieved of having to remove the at least one filter element from the dirty side, i.e., from the side of the filter element facing the dirt collection container. In addition, the filter cover has a further function, in that it comprises the at least one battery receptacle for the at least one battery, which is thus held on the filter cover on the vacuum appliance. As the result of single access on the vacuum appliance, the user can carry out servicing operations that typically must be performed most frequently during maintenance of the vacuum appliance, namely, replacing the at least one filter element and exchanging the at least one rechargeable battery, in a user-friendly manner. In addition, the user does not have to take note of where on the vacuum appliance, he must take hold in order to replace the at least one filter element and to exchange the at least one battery. Confusion in this regard by the user are no longer possible, so that the vacuum appliance according to an aspect of the invention is easier for the user to service.

As the result of integrating two functions into the filter cover, namely, covering the at least one filter element and holding the at least one battery, a simpler construction and a more compact design of the vacuum appliance may also be achieved. The more compact design results in a higher degree of mobility of the vacuum appliance according to an aspect of the invention, which proves to be advantageous in particular for the specialized design of the vacuum appliance as a battery-operated vacuum appliance.

It is advantageous if the at least one battery receptacle is situated on a side of the filter cover facing away from the suction chamber, since this allows better protection of the at least one battery from dirt.

The at least one battery receptacle is preferably situated on a top side of the filter cover, wherein in the present context, location and position indications such as "top side," "bottom side," "horizontal," "vertical," and the like are to be construed as relating to an operating position of the vacuum appliance in which the vacuum appliance is positioned on a horizontally oriented standing surface. Situating the at least one battery receptacle on the top side of the filter cover makes it easier for the user to access the at least one battery in order to change it. In addition, the weight of the at least one battery can be used to sealingly close the suction chamber, for example by directing the weight onto an edge of the filter cover which covers the at least one filter element.

The vacuum appliance advantageously includes a filter cleaning device for cleaning the at least one filter. This makes it possible for the suction power of the vacuum appliance to remain substantially at a constant level as the result of cleaning the at least one filter element. In addition, the replacement interval for the at least one filter element is prolonged. The filter cleaning device may be manually activatable. It may also be provided that the filter cleaning device is activated automatically, for example in a time-controlled manner, by control electronics of the vacuum appliance. In addition, demand-related control of the filter cleaning device in dependence on the type and quantity of the sucked-in vacuumed material is conceivable.

It is advantageous if the filter cleaning device is mounted on the filter cover, particularly preferably situated in the suction chamber. This allows a configuration having a simple construction, and a compact design of the vacuum appliance. As the result of transferring the filter cover into the removal position. the filter cleaning device is also easily accessible to the user for maintenance, so that the filter cleaning device for the vacuum appliance according to an aspect of the invention may also be serviced in a user-friendly manner.

It is advantageous if the filter cover in the closed position, or a filter cleaning device mounted on the filter cover in the closed position of the filter cover, sealingly closes the suction chamber. This allows a configuration of the vacuum appliance having a simple construction, in which separate sealing of the suction chamber may be dispensed with.

The filter cover is preferably mounted on the vacuum appliance so as to be pivotable about a first pivot axis. The filter cover can thus be transferred from the closed position into the removal position, and vice versa, in a defined way in a user-friendly manner. For example, the first pivot axis is horizontally aligned, and the filter cover can be swung upwardly for transferring from the closed position into the removal position, so that the user easily gains access to the at least one filter element.

It is advantageous if the vacuum appliance includes a first arresting device for arresting the filter cover in the removal position. As a result, the user does not have to hold the filter cover in the removal position, thus simplifying replacement of the at least one filter element.

Correspondingly, it may be provided that the vacuum appliance has a first locking device for locking the filter cover in the closed position, in particular to ensure a sealing closure of the suction chamber.

The first arresting device and the first locking device may each be configured as latching devices, for example. A configuration in each case as clamping devices is also conceivable. The first arresting device and/or the first locking device is/are advantageously manually activatable for user-friendly operation.

The vacuum appliance preferably includes a battery compartment in which the at least one battery and the at least one battery receptacle are located, as well as a battery compartment cover which is transferrable from a closed position in which the battery compartment cover closes the battery compartment, into an open position in which the battery compartment is open, and vice versa. In the closed position, the battery compartment cover covers the at least one battery receptacle and the at least one battery mounted in the battery receptacle. The battery compartment cover thus protects the at least one battery and the at least one battery receptacle from dirt and moisture in order to ensure proper functioning of the vacuum appliance. The battery compartment is opened by transferring the battery compartment cover from the closed position into the open position. In this way, the user gains access to the at least one battery, for example to change it.

It may be provided that the user gains access to the filter cover only after the battery compartment cover has been transferred from the closed position into the open position, in order to likewise transfer the filter cover from its closed position into its removal position for replacing the at least one filter element.

The vacuum appliance preferably includes a second arresting device for arresting the battery compartment cover in the open position. The user is thus relieved, for example, of having to hold the battery compartment cover in the open position while exchanging the at least one battery, and optionally while transferring the filter cover from its closed position into its removal position, and vice versa, for replacing the at least one filter element.

Similarly, it may be provided that the vacuum appliance has a second locking device by means of which the battery compartment cover is lockable in its closed position in order to ensure reliable protection of the at least one battery from dirt and moisture.

The second arresting device and the second locking device may each be configured as a latching device. A configuration in each case as a clamping device is also conceivable. The second arresting device and the second locking device are advantageously manually activatable for user-friendly operation.

The battery compartment cover is preferably arrestable in the open position only when the at least one battery has been removed from the battery compartment. In order to be approved for sale, certain configurations of the vacuum appliance according to an aspect of the invention must undergo a splash water test. According to requirements, this type of splash water test must be carried out with the covers of the vacuum appliance open; i.e., the battery compartment cover must be in its open position, and the filter cover must be in its removal position. Thus, in this embodiment of the vacuum appliance according to an aspect of the invention, it may be ensured that the at least one battery is not situated in the battery compartment during the splash water test. This is particularly important when the at least one battery is a high-power accumulator, which, for cooling, may have housing openings through which entry of spray water during the splash water test in principle cannot be excluded. However, this may be avoided by removing the at least one battery from the battery compartment prior to the splash water test, only after which removal is the battery compartment cover arrestable in the open position for carrying out the splash water test.

It is advantageous if the filter cover in the removal position and the battery compartment cover in the open position are arrestable against one another to prevent transfer into the respective closed position. A configuration of the vacuum appliance which has a particularly simple construction may thus be achieved. In the present case, the above-mentioned first arresting device for arresting the filter cover in its removal position is, in a manner of speaking, formed by the battery compartment cover or is located on same. Similarly, the above-mentioned second arresting device for arresting the battery compartment cover in its open position is formed by the filter cover or is situated on same. The battery compartment cover and the filter cover thus form an assembly for mutual arresting in the removal position and in the open position.

In a configuration having a particularly simple construction, the battery compartment cover in the open position and the filter cover in the removal position are latchable to one another.

The structural configuration of the vacuum appliance is advantageously further simplified in that, apart from the filter cover, no further arresting device for arresting the battery compartment cover is provided, and that, apart from the battery compartment cover, no further arresting device for arresting the filter cover on the vacuum appliance is provided.

The battery compartment cover is preferably mounted on the vacuum appliance so as to be pivotable about a second pivot axis. This allows the user to easily transfer the battery compartment cover from its closed position into the open position, and vice versa, in a defined manner. The second pivot axis is horizontally aligned, for example, and the battery compartment cover can be swung upwardly to make it easier for the user to access the at least one battery.

It is advantageous if the first pivot axis and the second pivot axis are different, for example being parallel to one another and in each case horizontally aligned. When the filter cover is in its removal position and the battery compartment cover is in its open position, and the battery compartment cover and the filter cover are arrested against one another, the filter cover and the battery compartment cover are secured against being transferred into their respective closed position, as already described above.

The vacuum appliance preferably includes a cooling device for cooling the at least one battery. It is thus possible to avoid overheating of the at least one battery and to ensure proper functioning of the vacuum appliance.

The cooling device advantageously includes at least one exhaust air duct for exhaust air from the at least one battery, which exhaust air duct has at least one inlet opening, for the exhaust air, at the at least one battery receptacle. This allows waste heat from the at least one battery to be transported away from its site of generation in order to ensure reliable cooling of the at least one battery.

It is advantageous if the at least one inlet opening is formed as a through-opening in a support surface for the at least one battery in the at least one battery receptacle, the through-opening at least partially overlapping a housing opening of the at least one battery. Warn exhaust air from the at least one battery can exit from the at least one housing opening, and can pass through the at least one through-opening into the at least one exhaust air duct. It has been shown in practice that the waste heat from the at least one battery may thus be discharged in a particularly reliable manner.

In a structurally simple embodiment of the cooling device, the filter cover is configured, at least in part, as a hollow body which forms the at least one exhaust air duct.

The cooling device preferably includes at least one fan wheel for conveying cooling air for the at least one battery and/or for conveying exhaust air from the at least one battery. The at least one battery may be cooled even more effectively by use of the fan wheel.

It is particularly advantageous if the at least one fan wheel is situated in the at least one exhaust air duct of the cooling device. The air stream which is generatable by the at least one fan wheel allows particularly effective cooling of the at least one battery.

The vacuum appliance is advantageously a hybrid vacuum cleaner having a connecting cable which is connectable to a energy supply network for providing electrical energy to the suction unit. This allows more versatile use of the vacuum appliance, which may be operated on the energy supply network as well as on battery power. Furthermore, it may be provided that the at least one battery is chargeable when the at least one connecting cable is connected to the energy supply network.

FIG. 1 shows a perspective illustration of a preferred embodiment of a vacuum appliance according to an aspect of the invention, denoted overall by reference numeral 10. The vacuum appliance 10 is configured as a so-called wet-dry vacuum cleaner by means of which solids as well as liquids may be sucked in. The vacuum appliance includes an appliance bottom part 12, which in a manner known per se has a dirt collection container 14 for separating sucked-in vacuumed material, and which may be moved on a floor surface by means of rollers 16, 18 and wheels (only one wheel 20 being shown).

The vacuum appliance 10 also includes an appliance top part 22, which in an operating position of the vacuum appliance 10 is detachably mounted on the device bottom part 12 and can be fixed to same. In the device top part 22, also referred to as the "suction head," a suction unit 24 which is only schematically illustrated in FIGS. 4 and 5 is accommodated in an accommodating chamber 26. By means of the suction unit 24, a negative pressure can be generated in the dirt collection container 14 via a suction chamber 28 formed in the device top part 22, so that vacuumed material can be sucked into the dirt collection container 14 via a suction hose, not illustrated in the drawing, which is connected to a connecting element 30 of the device top part 22.

In the flow direction of the air sucked in by the suction unit 24, a filter element 32 which is detachable by an operator is mounted between the dirt collection container 14 and the suction chamber 28. The filter element 32, which may be a flat-fold filter, for example, is supported in a manner known per se in the direction of the dirt collection container 14 on a circumferential edge 34, shown only partially in FIGS. 4 and 5.

The location of the connecting element 30 on the vacuum appliance 10 defines the front side 36 of the vacuum appliance. On its opposite side, the vacuum appliance 10 has a rear side 38. In the present case, other position and direction indications such as "bottom side," "top side," and the like are to be construed as relating to an operating position, illustrated in FIG. 1, of the vacuum appliance 10, in which the vacuum appliance 10 is positioned on a horizontally oriented standing surface, not shown.

In the transition from a top side 40 of the device top part 22 to the rear side 38, the device top part 22 includes a battery compartment cover 42. The battery compartment cover 42 is mounted on the device top part 22 so as to be pivotable about a horizontal pivot axis 44 extending in the transverse direction of the device top part, and is thus transferable from a closed position, illustrated in FIG. 1, into an open position illustrated in FIGS. 4 and 5, and vice versa.

In the open position, the battery compartment cover 42 opens up a battery compartment 46, situated underneath, in which two rechargeable batteries 48 and 50 can be removably positioned. The batteries 48 and 50 are used for providing electrical energy in particular to the suction unit 24, so that the vacuum appliance 10 can be operated even when it is not connected to a energy supply network. In its closed position, the battery compartment cover 42 covers the battery compartment 46 and the batteries 48 and 50 accommodated therein in order to protect them from dirt and moisture (FIG. 1).

In the closed position, the battery compartment cover 42 is lockable to a carrier part 54 of the device top part 22 by means of a locking device 52. For this purpose, the carrier part 54 has a locking element 56 which can cooperate with a corresponding locking element 58 of the battery compartment cover 42, for example by latching.

The vacuum appliance 10 is a hybrid vacuum cleaner which may be operated not only by means of the batteries 48 and 50, but also on a energy supply network. For this purpose, the vacuum appliance 10 includes a connecting cable, not illustrated in the drawing, which in a conventional manner has a plug for connection to a energy supply network in order to supply the vacuum appliance 10 with electrical energy.

For mounting the batteries 48 and 50, the device top part 22 has two battery receptacles 60 and 62 which have a mirror-image configuration relative to one another with respect to a central longitudinal plane of the vacuum appliance 10. The batteries 48 and 50 have an identical configuration, and can be inserted into the battery receptacles 60 and 62, respectively, so that only the battery 48 and the battery receptacle 60 are discussed below.

As is apparent in particular from FIGS. 3 and 6, the battery receptacle 60 includes a plate-shaped support element 64 for a housing 66 of the battery 48. Furthermore, the housing 66 can engage in a positive-fit manner with two L-shaped guides 68 and 70 adjacent to the support element 64, so that the battery 48 is securely held in the battery receptacle 60 via a positive-fit connection. With reference to the illustration in FIG. 6, it has to be borne in mind that only the approximate outer contours of the batteries 48 and 50 are represented by dashed lines, but for reasons of clarity the positive-fit seat of the batteries 48 and 50 in the guides 68 and 70 is not shown.

A contact element 72 having electrical contacts is used for electrically contacting the battery 48, which for this purpose has a corresponding contact element, not illustrated in the drawing.

The battery receptacles 60 and 62 are comprised by a substantially plate-shaped filter cover 74 for covering the filter element 32, on the top side of which the battery receptacles are formed. The filter cover 74 serves to delimit the suction chamber 28 on the top side, and a filter cleaning device 76 is mounted on the bottom side of the filter cover 74 facing the filter element 32.

The filter cleaning device 76 is a device, known per se, for automatically cleaning the filter element 32, in particular in a time-controlled manner, by means of a pressure surge which acts on the filter element 32 on the clean space side. The pressure surge penetrates the filter element 32 in the direction of the dirt collection container 14, so that dirt particles adhering to the filter element 32 on the dirt collection container side are detached from the filter element 32 and fall into the dirt collection container 14.

To initiate the pressure surge, an inflow of external air, also referred to as "additional air," into the suction chamber 28 is necessary. For this purpose, the filter cleaning device 76 is provided with an automatically activatable closing valve 78 which may be controlled in a time-dependent manner by control electronics of the vacuum appliance 10, not illustrated in the drawing and likewise known per se. By opening the closing valve 78, additional air from the atmosphere can enter through gaps formed between the filter cover 74 and the rest of the device top part 22, and through the filter cleaning device 76 into the suction chamber 28, and can act on the filter element 32 on the clean space side.

The suction chamber 28 is sealed by means of the filter cleaning device 76, which, adjoining the edge 34 at a wall 80, can sealingly abut against an edge 82 of the filter element 32 with a wall 80 (FIG. 4). In addition, the suction chamber 28 is sealed by means of a border 84 opposite to the wall 80. The border 84 bounds a through opening 86 via which the suction chamber 28 and the accommodating chamber 26 for the suction unit 24 open into one another.

The same as the battery compartment cover 42, the filter cover 74 is pivotably mounted on the device top part 22, in particular so that it can pivot about a horizontal pivot axis 88 aligned parallel to the pivot axis 44. The filter cover 74 is thus transferable, relative to the device top part 22, from a closed position illustrated in FIGS. 2 to 4 and FIG. 6 into a removal position illustrated in FIG. 5, and vice versa.

In the closed position, the filter cover 74 covers the suction chamber 28 and thus in particular the filter element 32. In addition, as explained above, the suction chamber 28 is sealingly closed by means of the filter cleaning device 76. This occurs in the normal operating state of the vacuum appliance 10.

A locking device 90, for example in the form of a latching device, is provided in order to lock the filter cover 74 in its closed position on the device top part 22. For this purpose, a locking element 92 is situated on the device top part 22, and a locking element 94 is situated on the filter cover 74 (FIG. 5).

When the filter cover 74 has been transferred from the closed position into the removal position, the filter element 32 is removable from the device top part 22, on the clean space side, by the user through the suction chamber 28. Correspondingly, the filter element 32 can be inserted through the suction chamber 28 on the clean space side into the device top part 22 and placed against the edge 34. The user is thus able to replace the filter element 32 in a user-friendly manner with little or no soiling.

In addition, the filter cleaning device 76 in the removal position of the filter cover 74 is easily accessible to the user. The filter cleaning device 76 may thus be serviced in a user-friendly manner. Access to the filter element 32 and to the filter cleaning device 76 by the user is further simplified in that the filter cover 74 can be pivoted upwardly, so that turning the vacuum appliance 10 beforehand and/or an excessively stooped posture for the user is/are not necessary.

As is apparent from FIG. 5, the battery compartment cover 42 is arrestable in the open position and the filter cover 74 is arrestable in the removal position, and in particular the battery compartment cover 42 and the filter cover 74 are arrestable against one another. Thus, the battery compartment cover 42 has an arresting device 96 for the filter cover 74 having an arresting member 98, and the filter cover 74 has an arresting device 100 for the battery compartment cover 42 having an arresting member 102.

The arresting members 98 and 102 are latching elements which can engage with one another in the open position of the battery compartment cover 42 and the removal position of the filter cover 74 (FIG. 5). The arresting member 98 is a latching hook situated on the underside of the battery compartment cover 42, and the arresting member 102 is a latching projection situated on the upper side of the filter cover 74. This latching projection is biased with respect to the arresting member 98 by means of an elastic element 104, so that forced latching between the filter cover and the battery compartment cover 42 occurs when the filter cover 74 is opened. By activating a release member 106 against the action of the elastic element 104, the latching between the arresting members 98 and 102 may be released, thus returning the filter cover 74 and the battery compartment cover 42 to their respective closed position.

However, when the battery compartment cover 42 in the open position and the filter cover 74 in the removal position are arrested against one another, pivoting into their respective closed positions is not possible, since the pivot axes 44 and 88 are different. The arresting of the battery compartment cover 42 and the filter cover 74 against one another is advantageous for the user, since the user easily gains access to the filter element 32 and the filter cleaning device 76 without having to hold one of the two covers.

However, it must be borne in mind that arresting the battery compartment cover 42 in the open position and the filter cover 74 in the removal position is possible only when the batteries 48 and 50 have previously been removed from the battery receptacles 60 and 62, respectively. Only after this has been carried out, can the filter cover 74 be pivoted far enough about the pivot axis 88 that the arresting members 98 and 102 can be brought into latching engagement with one another. This type of configuration of the vacuum appliance 10 results from requirements for the vacuum appliance 10 to undergo a splash water test in order to be approved for sale. This splash water test provides for spraying the vacuum appliance 10 with spray water with the covers 42 and 74 open; no spray water must be allowed to penetrate into the electrical devices of the vacuum appliance 10. Removing the batteries 48 and 50 from the battery receptacles 60 and 62 before the covers 42 and 74 are arrested against one another ensures that the batteries 48 and 50 are protected from spray water. This is important, since the batteries have inlet openings 108 and 110 on the top side for cooling air, into which water could possibly penetrate. However, in the arrested state of the covers 42 and 74 against one another, the contact elements 72 are reliably protected from spray water and are able to withstand the splash water test.

Since the battery compartment cover 42 and the filter cover 74 are arrestable against one another only in the open position and the removal position, respectively, and the vacuum appliance 10 has no further arresting devices for the battery compartment cover 42 and the filter cover 74, the vacuum appliance 10 may have a structural configuration which is as simple as possible. In addition, the vacuum appliance according to an aspect of the invention has a compact design, and therefore a high degree of mobility. This is advantageous in particular due to the special configuration of the vacuum appliance as a battery-operated vacuum appliance. Servicing of the vacuum appliance 10 in a user-friendly manner is possible since the user can access the batteries 48 and 50 as well as the filter element 32 from only one side, by first transferring the battery compartment cover 42 from the closed position into the open position and, if necessary, subsequently transferring the filter cover 74 from its closed position into the removal position.

The batteries 48 and 50 are high-power accumulators which have a high level of heat generation during operation. To maintain proper functioning of the batteries 48 and 50, the vacuum appliance includes a cooling device 112 by means of which the batteries 48 and 50 can be effectively cooled.

To allow cooling of the batteries 48 and 50, the filter cover 74 is configured as a hollow body in regions. The filter cover 74 has a base plate 114 (FIG. 6) on which the support elements 64 are mounted in the region of the battery receptacles 60 and 62 to form a space in between. A cover 116 is mounted on the base plate 114 between the battery receptacles 60 and 62. An exhaust air duct 118 is thus formed between the base plate 114 on the one hand and the support elements 64 and the cover 116 on the other hand.

Starting from the rear side 38, the exhaust air duct 118 extends approximately along the central longitudinal plane of the vacuum appliance 10, and at the middle of the filter cleaning device 76 branches in a T-shaped manner toward the battery receptacles 60 and 62. On the side of the filter cover 74 facing away from the arresting member 102, the exhaust air duct 118 opens downwardly into a ventilation chamber 120 in which a fan wheel 122 of the cooling device 112 is situated.

In addition, in each case a plurality of inlet openings 124 for exhaust air from the batteries 48 and 50 into the exhaust air duct 118 of the cooling device 112 are formed in the support elements 64. The inlet openings 124 can align with outlet openings 126 formed on the bottom side of the housings 66 of the batteries 48 and 50 when the batteries 48 and 50 are held in the receptacles 60 and 62, respectively. This is schematically illustrated in FIG. 6.

The fan wheel 122 is in operation at least in battery mode of the vacuum appliance 10. This allows generation of a negative pressure in the exhaust air duct 118 so that cooling air can enter through the inlet openings 108 and 110 into the housings 66 of the batteries 48 and 50. Exhaust air from the batteries 48 and 50 can enter the exhaust air duct 118 through the outlet openings 126 and the inlet openings 124, and can be discharged through this exhaust air duct by means of the fan wheel 122. In practice, it has been shown that effective cooling of the batteries 48 and 50 can be achieved in this way.

That which is claimed:

1. A vacuum appliance comprising a dirt collection container for sucked-in vacuumed material, a suction chamber, a suction unit for subjecting the dirt collection container to the action of negative pressure via the suction chamber, at least one filter element situated in an opening between the dirt collection container and the suction chamber, with respect to the flow direction of the air which is sucked in by the suction unit, the at least one filter element comprising a dirty side facing the dirt collection container and a clean side facing the suction chamber, the vacuum appliance further comprising at least one rechargeable battery for providing electrical energy for the suction unit, and at least one battery receptacle for holding the at least one battery on the vacuum appliance, wherein the vacuum appliance includes a filter cover which is transferrable from a closed position in which the at least one filter element is covered, to a removal position in which the at least one filter element is removable from and insertable into the vacuum appliance, wherein the clean side of the filter element is accessible when the filter cover is in the removal position, and which filter cover comprises the at least one battery receptacle for the at least one battery.

2. The vacuum appliance according to claim 1, wherein the at least one battery receptacle is situated on a side of the filter cover facing away from the suction chamber.

3. The vacuum appliance according to claim 1, wherein the at least one battery receptacle is situated on a top side of the filter cover.

4. The vacuum appliance according to claim 1, wherein the vacuum appliance includes a filter cleaning device for cleaning the at least one filter element.

5. The vacuum appliance according to claim 4, wherein the filter cleaning device is mounted on the filter cover.

6. The vacuum appliance according to claim 4, wherein the filter cleaning device is mounted on the filter cover and, in the closed position thereof, abuts against an edge of the at least one filter element to seal the filter element within the opening.

7. The vacuum appliance according to claim 1, wherein the filter cover is mounted on the vacuum appliance so as to be pivotable about a pivot axis.

8. The vacuum appliance according to claim 1, wherein the vacuum appliance includes an arresting device for arresting the filter cover in the removal position.

9. The vacuum appliance according to claim 1, wherein the vacuum appliance includes a battery compartment in which the at least one battery and the at least one battery receptacle are located, as well as a battery compartment cover which is transferrable from a closed position in which the battery compartment cover closes the battery compartment, into an open position in which the battery compartment is open, and vice versa.

10. The vacuum appliance according to claim 9, wherein the vacuum appliance includes an arresting device for arresting the battery compartment cover in the open position.

11. The vacuum appliance according to claim 10, wherein the battery compartment cover is arrestable in the open position only when the at least one battery has been removed from the battery compartment.

12. The vacuum appliance according to claim 9, wherein the filter cover in the removal position and the battery compartment cover in the open position are arrestable against one another to prevent transfer into the respective closed position.

13. The vacuum appliance according to claim 12, wherein, apart from the filter cover, no further arresting device for arresting the battery compartment cover is provided, and that, apart from the battery compartment cover, no further arresting device for arresting the filter cover is provided.

14. The vacuum appliance according to claim 9, wherein the battery compartment cover is mounted on the vacuum appliance so as to be pivotable about a pivot axis.

15. The vacuum appliance according to claim 14, wherein the pivot axis about which the battery compartment cover is pivotable is different from another pivot axis about which the filter cover is pivotably mounted on the vacuum appliance.

16. The vacuum appliance according to claim 1, wherein the vacuum appliance includes a cooling device for cooling the at least one battery.

17. The vacuum appliance according to claim 16, wherein the cooling device includes at least one cooling air duct for cooling air passing through the at least one battery, which cooling air duct has at least one inlet opening, for the cooling air, at the at least one battery receptacle.

18. The vacuum appliance according to claim 17, wherein the at least one inlet opening is formed as a through-opening in a support surface for the at least one battery in the at least one battery receptacle, the through-opening at least partially overlapping a housing opening of the at least one battery.

19. The vacuum appliance according to claim 17, wherein the filter cover is configured, at least in part, as a hollow body which forms the at least one exhaust air duct.

20. The vacuum appliance according to claim 17, wherein the cooling device includes at least one fan wheel for conveying cooling air for the at least one battery and/or for pulling cooling air through the at least one battery.

21. The vacuum appliance according to claim 20, wherein the at least one fan wheel is situated in the at least one cooling air duct of the cooling device.

22. The vacuum appliance according to claim 1, wherein the vacuum appliance is a hybrid vacuum cleaner having a connecting cable which is connectable to a energy supply network for providing electrical energy to the suction unit.

23. The vacuum appliance according to claim 12, wherein the battery compartment cover is arrestable in the open position only when the at least one battery has been removed from the battery compartment.

24. A vacuum appliance comprising a dirt collection container for sucked-in vacuumed material, a suction unit for subjecting the dirt collection container to the action of negative pressure via a suction chamber, at least one filter element situated between the dirt collection container and the suction chamber in the flow direction of the air which is sucked in by the suction unit, at least one rechargeable battery for providing electrical energy for the suction unit, and at least one battery receptacle for holding the at least one battery on the vacuum appliance, wherein the vacuum appliance includes a filter cover which is transferrable from a closed position in which the at least one filter element is covered, to a removal position in which the at least one filter element is removable from and insertable into the vacuum appliance on the clean space side, and vice versa, and which filter cover comprises the at least one battery receptacle for the at least one battery, wherein the vacuum appliance includes a battery compartment in which the at least one battery and the at least one battery receptacle are located, as well as a battery compartment cover which is transferrable from a closed position in which the battery compartment cover closes the battery compartment, into an open position in which the battery compartment is open, and vice versa, and wherein the vacuum appliance includes an arresting device for arresting the battery compartment cover in the open position.

25. The vacuum appliance according to claim 24, wherein the battery compartment cover is arrestable in the open position only when the at least one battery has been removed from the battery compartment.

26. A vacuum appliance comprising a dirt collection container for sucked-in vacuumed material, a suction unit for subjecting the dirt collection container to the action of negative pressure via a suction chamber, at least one filter element situated between the dirt collection container and the suction chamber in the flow direction of the air which is sucked in by the suction unit, at least one rechargeable battery for providing electrical energy for the suction unit, and at least one battery receptacle for holding the at least one battery on the vacuum appliance, wherein the vacuum appliance includes a filter cover which is transferrable from a closed position in which the at least one filter element is covered, to a removal position in which the at least one filter element is removable from and insertable into the vacuum appliance on the clean space side, and vice versa, and which filter cover comprises the at least one battery receptacle for the at least one battery, wherein the vacuum appliance includes a battery compartment in which the at least one battery and the at least one battery receptacle are located, as well as a battery compartment cover which is transferrable from a closed position in which the battery compartment cover closes the battery compartment, into an open position in which the battery compartment is open, and vice versa, and wherein the filter cover in the removal position and the battery compartment cover in the open position are arrestable against one another to prevent transfer into the respective closed position.

27. The vacuum appliance according to claim 26, wherein, apart from the filter cover, no further arresting device for arresting the battery compartment cover is provided, and that, apart from the battery compartment cover, no further arresting device for arresting the filter cover is provided.

* * * * *